US007331832B2

(12) United States Patent
Yang et al.

(10) Patent No.: US 7,331,832 B2
(45) Date of Patent: Feb. 19, 2008

(54) STRUCTURE OF FOCUSING MESH FOR FIELD EMISSION DISPLAY

(75) Inventors: Frank Yang, Guanyin Township, Taoyuan County (TW); Yao-Zong Chen, Guanyin Township, Taoyuan County (TW)

(73) Assignee: Teco Nanotech Co., Ltd., Taoyuan (TW)

( * ) Notice: Subject to any disclaimer, the term of this patent is extended or adjusted under 35 U.S.C. 154(b) by 0 days.

(21) Appl. No.: 11/548,277

(22) Filed: Oct. 10, 2006

(65) Prior Publication Data

US 2007/0126336 A1 Jun. 7, 2007

Related U.S. Application Data

(63) Continuation-in-part of application No. 10/883,717, filed on Jul. 6, 2004, now abandoned.

(51) Int. Cl.
*H01R 4/02* (2006.01)

(52) U.S. Cl. ..... 439/876

(58) Field of Classification Search ..... 439/876, 439/74

See application file for complete search history.

(56) References Cited

U.S. PATENT DOCUMENTS 6,439,115 B1 * 8/2002 Michiels et al. ..... 101/129

* cited by examiner

*Primary Examiner*—Javaid H. Nasri

(57) ABSTRACT

A structure of a focusing mesh for a field emission display includes a cathode substrate and a rectangular mesh. The cathode substrate with one edge formed a cathode conductor including a joint area. The mesh includes a plurality of pores formed in matrix and a L-shaped recess formed at one side of the mesh to provide a rectangular strip as a leading wire of the mesh drooped by self weight to contact with the joint area of the cathode conductor. As such, during vacuuming to envelop the field emission display, it will not cause the crack of wire, air leakage and even make easier to be enveloped and increase the good fabrication rate of a field emission display.

6 Claims, 4 Drawing Sheets

STRUCTURE OF FOCUSING MESH FOR FIELD EMISSION DISPLAY

RELATED APPLICATIONS

This application is a continuation-in-part of U.S. patent application Ser. No. 10/883,717, filed on Jul. 6, 2004, now abandoned.

BACKGROUND OF THE INVENTION

The present invention is related to a field emission display and, in particular, to a structure of a focusing mesh for a field emission display.

It is known that the structure of the current field emission displays can be divided as 2, 3 and 4 pole types. The structure of 3 and 4 pole field emission displays both have metal mesh. When applying a controlled voltage to the metal mesh, the electron beams from the cathode plate successfully pass the metal mesh and reflect to the anode plate to display the images. Owing to the material difference with glass colloid, the cathode and anode plates, the metal mesh extends outside of the element and to be deemed as a leading wire. However, the foregoing method cannot provide the structure to be airtight enough, and thereby cause the insufficient vacuum and even sometimes happen air leakage.

In order to overcome the depicted defeats, a metal mesh is entirely enveloped within the cathode and anode plates, and additionally fabricates a leading wire extended outside of the element. Nevertheless, this method has some drawbacks as following:

1. Referring to FIGS. 1 and 2, a three-dimensional leading wire 5 is built between the metal mesh 3 and the cathode plate 4. Printing a conductor 6 in the cathode plate 4 to extend outside of the element and then reach the purpose of vertical wire joint. Yet, the defeat is the complex process of fabricating and thus results the three-dimensional leading wire 5 easy to occur a short circuit.

2. Referring to FIG. 3, printing a silver colloid leading wire 7 between the metal mesh 3 and the cathode plate 4. However, it only can be used under the between distance is within a designated range. When the distance is beyond the range, the extensibility of silver colloid will exceed itself material allowed. In the application of vertical wire joint, it occurs a bad continuous phenomenon and even a break circuit.

3. Referring to FIGS. 4 and 5, a leading wire 31 extended outside is vertical to the edge of the metal mesh 3. By deforming the leading wire 31 and connecting it to the cathode plate 4, the vertical extension of the leading wire 31 makes the metal mesh 3 deformed to affect the restrained pore structure within the effective area 32 of the metal mesh 3 and thereby increase the non-effective area 33.

BRIEF SUMMARY OF THE INVENTION

The present invention is to solve the foregoing problems and avoid the possible drawbacks. The present invention is to provide a focusing mesh for a field emission display. The fabrication will not take extra costs, affect the integral structure, and/or occur a short or break circuit. Furthermore, the fabriation will not influence the installment of effective and non-effective areas in the structure and further simplify the usage of the non-effective area.

Accordingly, a structure of a focusing mesh for a field emission display includes a cathode substrate and a rectangular mesh. The cathode substrate with one edge formed a cathode conductor including a joint area. The mesh includes a plurality of pores formed in matrix and a L-shaped recess formed at one side of the mesh to provide a rectangular strip as a leading wire of the mesh drooped by self weight to contact with the joint area of the cathode conductor. As such, during vacuuming to envelop the field emission display, it will not cause the crack of wire, air leakage and even make easier to be enveloped and increase the good fabrication rate of a field emission display.

These and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

The above objects and advantages of the present invention will be become more apparent by describing in detail exemplary embodiments thereof with reference to the attached drawings in which.

DETAILED DESCRIPTION OF THE INVENTION

Figure 1:
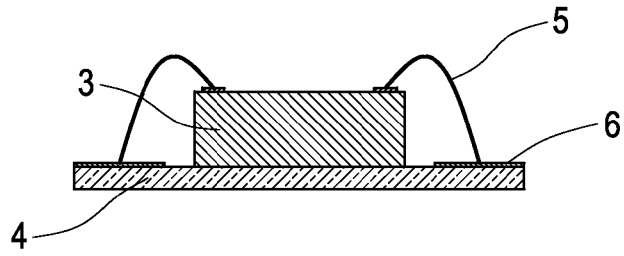
FIG.1 PRIOR ART
FIG. 1 shows a side view of a joint of a leading wire between the metal mesh and the cathode plate of a conventional field emission display.
Figure 2:
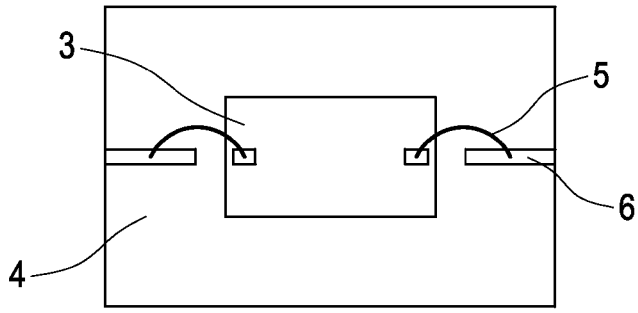
FIG.2 PRIOR ART
FIG. 2 shows a plan view of a wire joint between the metal mesh and the cathode plate of a conventional field emission display.
Figure 3:
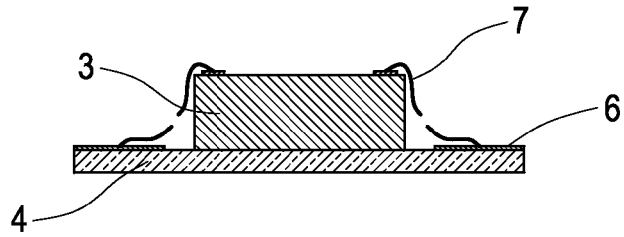
FIG.3 PRIOR ART
FIG. 3 shows a side view of a bad wire joint between the metal mesh and the cathode plate of a conventional field emission display.
Figure 4:
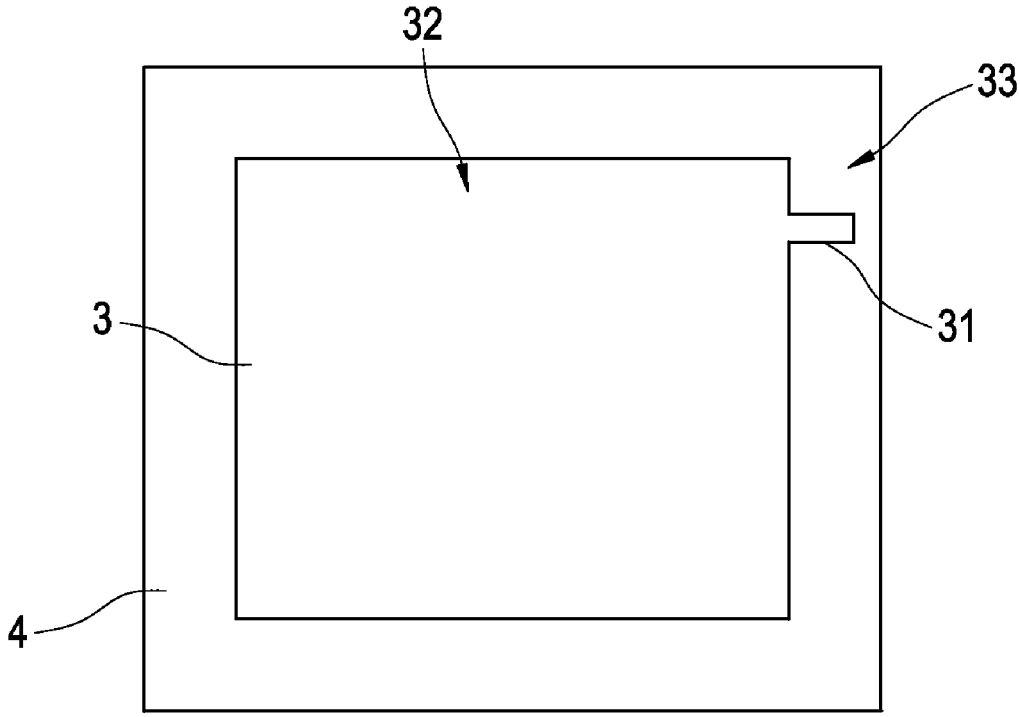
FIG.4 PRIOR ART
FIG. 4 shows a plan view of an assembly of the metal mesh and the cathode plate of a conventional field emission display.
Figure 5:
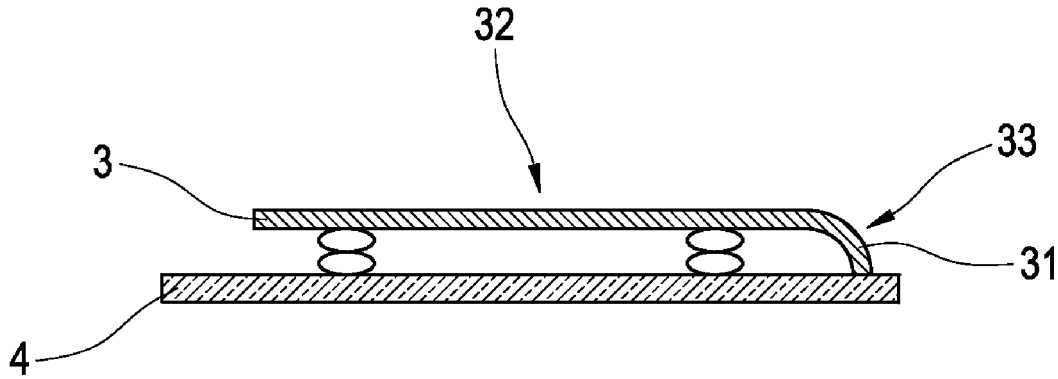
FIG.5 PRIOR ART
FIG. 5 shows a side view of an assembly of the metal mesh and the cathode plate of a conventional field emission display.

Reference will now be made in detail to the preferred embodiments of the present invention, examples of which are illustrated in the accompanying drawings. Wherever possible, the same reference numbers are used in the drawings and the description to refer to the same or like parts.

Figure 6:
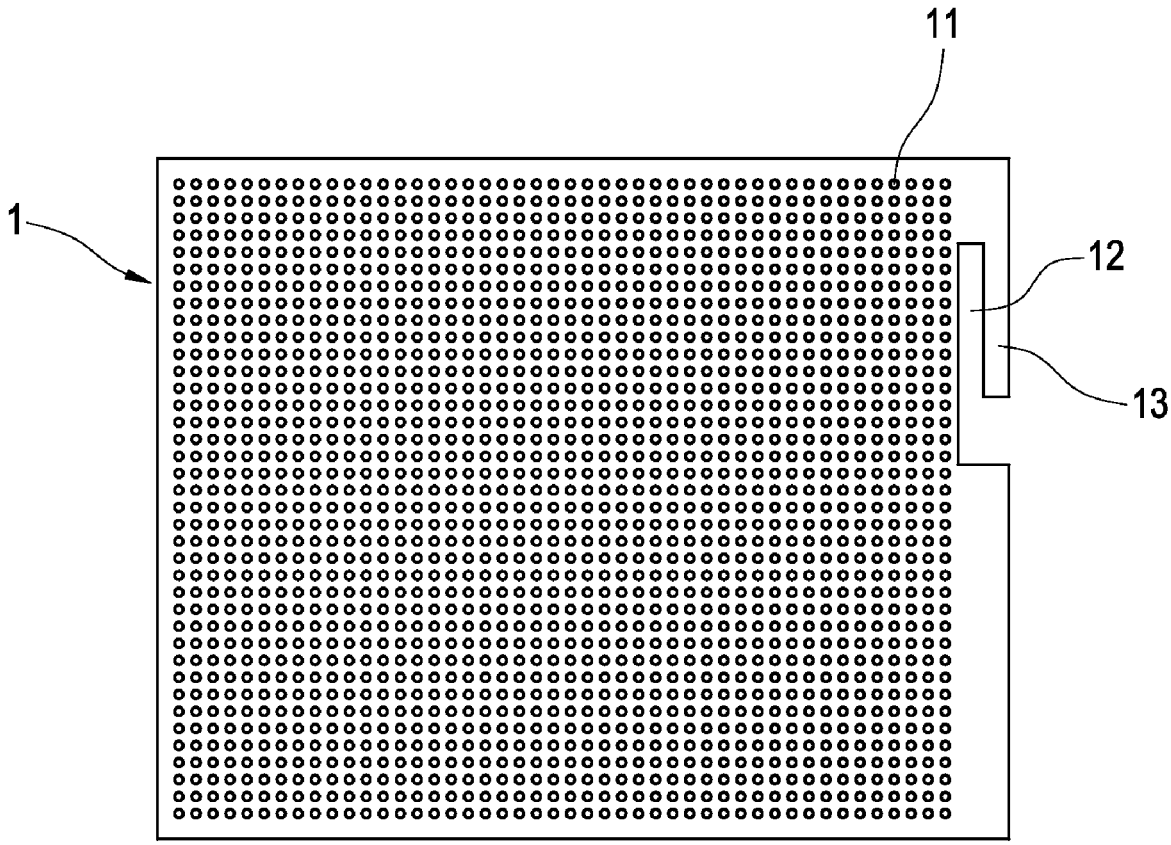
FIG. 6 is a diagram of the focusing mesh according to the present invention.

Please refer to FIG. 6, which shows a focusing mesh for a field emission display according to the present invention. A rectangular mesh 1 of the present invention is made by a compound material of iron, nickel and carbon with an expansion coefficient between 82~86 $10^{-7}/°$ C. The mesh 1 has a plurality of pores 11 formed in matrix to focus (converge) the electron beams from the cathode substrate (not shown) to impinge on the anode substrate (not show) for light generation. Moreover, a L-shaped recess 12 is formed at one side of the mesh 1 to provide a rectangular strip 13 as a leading wire of the mesh 1. After the mesh 1 is assembled to the cathode substrate, the leading wire of the strip 13 will contact to the leading wire of the cathode substrate. It will prevent any crack of the leading wire and further prevent the air leakage when vacuum the field emission display for enveloping so that the fabrication rate of the field emission display will be increased.

Figure 7:
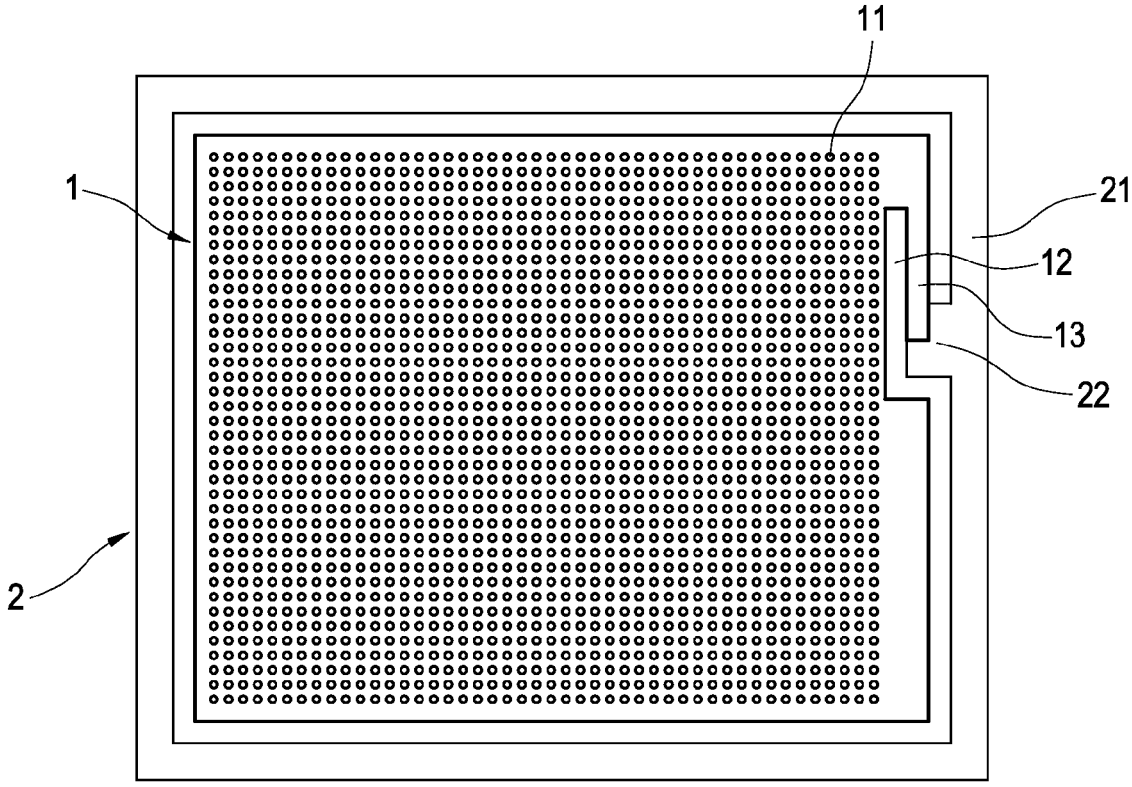
FIG. 7 is a plan view of the focusing mesh and the cathode substrate according to the present invention.
Figure 8:
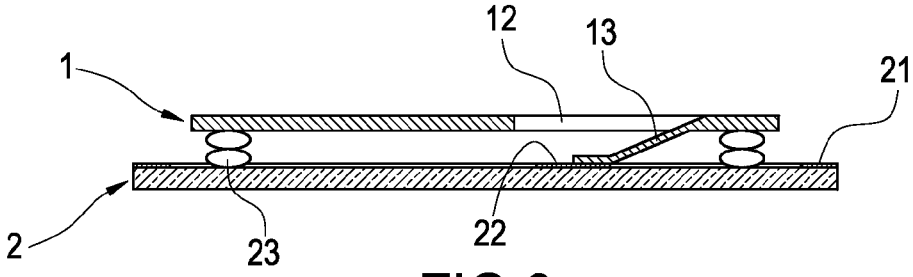
FIG. 8 shows a side view of the focusing mesh and the cathode substrate according to the present invention.

Please refer to FIGS. 7 and 8, which respectively show a plan view and a side view of a joint of a mesh and a cathode substrate in a field emission display. Fabricating a focusing mesh of a field emission display of the present invention includes the steps as follows.

First, a cathode substrate 2 is provided. The cathode substrate 2 is a glass substrate and should have a dimension larger than that of the mesh 1.

Next, when fabricating the cathode substrate 2, the silver colloid is formed along the edge of the cathode substrate 2 by method of screen print and/or coating and further forms a cathode conductor 21 including a joint area 22.

After the cathode conductor 21 is formed, the mesh 1 is attached to an insulating layer 23 of the cathode substrate 2. Because the dimension of the mesh 1 is quite big and the thickness of the mesh 1 is thinner than 0.2mm, the leading wire of the strip 13 will droop by its weight to the cathode conductor 21 and connect to the joint area 22 without applying an external force.

Moreover, the drooping of the leading wire of the strip 13 will not affect the pores 11 of the mesh 1 to be deformed.

After the leading wire of the strip 13 is connected to the joint area 22 of the cathode conductor 21, they are joined together by way of sintering. As such, during vacuuming to envelop the field emission display, it will not cause the crack of wire, air leakage and even make easier to be enveloped and increase the good fabrication rate of a field emission display.

Furthermore, forming the leading wire of the strip 13 on the mesh 1 will not take extra costs nor influence the integral structure or a short and break circuit. It will not influence the installment of effective and non-effective areas in the cathode substrate and fully simplify the usage of non-effective area.

While the present invention has been particularly shown and described with reference to preferred embodiments thereof, it will be understood by those of ordinary skill in the art the various changes in form and details may be made therein without departing from the spirit and scope of the present invention as defined by the appended claims.

What is claimed is:

1. A structure of a focusing mesh for a field emission display, comprising:

a cathode substrate with one edge formed a cathode conductor including a joint area; and a rectangular mesh to be assembled with the cathode substate, including a plurality of pores formed in matrix and a L-shaped recess formed at one side of the mesh to provide a rectangular strip as a leading wire of the mesh drooped by self weight to contact with the joint area of the cathode conductor.

2. The structure of claim 1, wherein the cathode substrate is a glass substrate.

3. The structure of claim 1, wherein a dimension of the cathode substrate is larger than that of the mesh.

4. The structure of claim 1, wherein the cathode conductor is made of silver colloid.

5. The structure of claim 1, wherein the mesh is made by a compound material of iron, nickel and carbon.

6. The structure of claim 1, wherein the mesh has an expansion coefficient between 82~86 $10^{-7}/^{\circ}$ C.

* * * * *